US005820735A

United States Patent [19]

Cabrera Y Lopez Caram

[11] Patent Number: 5,820,735

[45] Date of Patent: Oct. 13, 1998

[54] UNDER FELT INCLINED FLAT FORMER TO PRODUCE MULTILAYER OR MONOLAYER SHEET OF PAPER

[75] Inventor: Luis Fernando Cabrera Y Lopez Caram, Morelos, Mexico

[73] Assignee: Smurfit Carton y Papel De Mexico, Polanco, Mexico

[21] Appl. No.: 710,046

[22] Filed: Sep. 10, 1996

Related U.S. Application Data

[63] Continuation of Ser. No. 236,451, May 2, 1994, abandoned.

[51] Int. Cl.[6] ..... D21F 9/02; D21F 1/02

[52] U.S. Cl. ..... 162/354; 162/289; 162/348; 162/304; 162/344; 162/352

[58] Field of Search ..... 162/304, 133, 162/273, 274, 336, 337, 338, 339, 340, 341, 342, 343, 344, 300, 301, 306, 199, 214, 289, 354, 348, 352

[56] References Cited

U.S. PATENT DOCUMENTS

| | | | |
|---|---|---|---|
| 1,481,163 | 1/1924 | Van De Carr, Jr. . | |
| 2,755,710 | 7/1956 | Beachler | 162/273 |
| 2,894,581 | 7/1959 | Goumeniok | 162/339 |
| 3,328,236 | 6/1967 | Burgess, Jr. et al. | 162/342 |
| 3,357,880 | 12/1967 | Curtis . | |
| 3,770,580 | 11/1973 | Kallmes et al. | 162/341 |
| 3,795,576 | 3/1974 | Watanabe . | |
| 3,902,960 | 9/1975 | Zentner et al. | 162/199 |
| 3,923,595 | 12/1975 | Tokuno | 162/300 |
| 3,976,539 | 8/1976 | Kirjavainen | 162/344 |
| 3,989,587 | 11/1976 | Grossmann | 162/200 |
| 4,024,016 | 5/1977 | Gordon et al. | 162/214 |
| 4,100,018 | 7/1978 | Wahren et al. | 162/203 |
| 4,220,502 | 9/1980 | Levänen | 162/273 |
| 4,306,934 | 12/1981 | Seppanen | 162/209 |
| 4,683,027 | 7/1987 | Pitkäjärvi | 162/199 |
| 5,300,196 | 4/1994 | Kraft | 162/300 |

FOREIGN PATENT DOCUMENTS

| | | | |
|---|---|---|---|
| 2215130 | 1/1973 | Denmark . | |
| 187711 | 3/1906 | Germany . | |
| 369204 | 7/1971 | U.S.S.R. | D21F 1/100 |
| 9325753 | 12/1993 | WIPO . | |

*Primary Examiner*—Donald E. Czaja
*Assistant Examiner*—Jose S. Fortuna
*Attorney, Agent, or Firm*—Kane, Dalsimer, Sullivan, Kurucz, Levy, Eisele and Richard, LLP

[57] ABSTRACT

The present invention refers to an under felt inclined flat former for making multilayer or monolayer sheets of paper comprising a plurality of forming units arranged along a production line. Each of the forming units is supported on corresponding rigid supports and is provided with a rolls system on which the forming unit rests when the support are removed, in such a manner that the selected forming unit can be removed from the production line for cleaning or maintenance purposes, without interrupting the operation of the former equipment.

21 Claims, 7 Drawing Sheets

UNDER FELT INCLINED FLAT FORMER TO PRODUCE MULTILAYER OR MONOLAYER SHEET OF PAPER

This application is a continuation of application Ser. No. 08/236,451 filed on May 02, 1994, now abandoned.

FIELD OF INVENTION

The equipment of the present invention serves to form a sheet of paper under the felt line, this sheet can be for monolayer or multilayer paper. The paper sheet so formed has superior characteristics to that of a sheet made in a fourdrinier manufacturing table.

SUMMARY OF INVENTION

Fiber suspension is distributed through a head box over a forming table, allowing the fiber to freely orient according to a jet/fabric speeds rate, and to the hydraulic pattern generated by a forming activity lip.

The effect generated by a activity lip is supplemented by the pulse forming roll allowing the fibers to orient freely or in a controlled fashion according to the roll speed. The water remaining in the fiber suspension is drained in a box divided in three vacuum compartments, to reach a fixed dryness to make contact with a prior unit sheet or with a felt in the case of a first unit.

The equipment comprises a forming table in which the tilt can be adjusted according the manufacturing requirements. This forming table comprises a fabric to form the paper sheet, a breast roll also serving as fabric stretcher, forming and dewatering foils, a pulse forming roll, flat boxes, a cylinder mold or support roll, a guide roll and control elements, support structures to support the former equipment, water collection trays, and rails and rolls for maintenance of the former equipment to allow the unit to be removed from service without halting production. The equipment also comprises a fiber distribution head box oriented towards the formation table, as well as a suction slider to extract water from the inner part of the felt. It also is provided with a rubber couch roll which presses the felt and the sheet in such a manner that the paper sheet adheres to the felt and can be transferred to a next formation unit. The couch roll is provided with a mechanism for setting position against the cylinder mold shaft, as well as with a bellows system to raise the cylinder mold or to apply pressure against said cylinder mold. The equipment comprises showers to keep clean the support roll, the fabric and the breast roll. A doctor blade is located in the breast roll for keeping the roll clean and to divert the water drained in this zone to a tray. This unit has a system comprising two vertical structures and a lengthwise beam to provide rigidity thereto.

BACKGROUND OF THE INVENTION

Currently there are several types of multilayer paper formation equipments among which the following can be mentioned:

CYLINDER MACHINE, this machine forms the paper sheet draining the water through a mesh screen adhered to a cylinder. The formed sheet is transferred directly to a felt for further joining the next layer. In this machine there is no control on the fiber orientation nor in the draining speed of the fiber suspension.

FLAT FORMERS OVER FELT LINE, these formers have a flat table in the area of formation of the paper sheet, which once the paper sheet is formed, it is transferred to a felt completely surrounding the forming felt to thereafter pass under this formation unit and arrive to the next formation unit.

Most of the equipments of the prior art has several disadvantages, such as: inadequate formation, non-adjustable MD/CD tensile ratio, tendency to curl with sheeted paper, non-uniform CD profile (streaks), drop-off and speed limitations among others.

The present invention is intended to overcome the defects of the prior art equipments, having further advantages, since it allows control on the fiber orientation in a former equipment under the felt line. It also allows to stop a formation unit and the complete removal thereof from the production line without shooting-down the production process.

DETAILED DESCRIPTION

Figure 1:
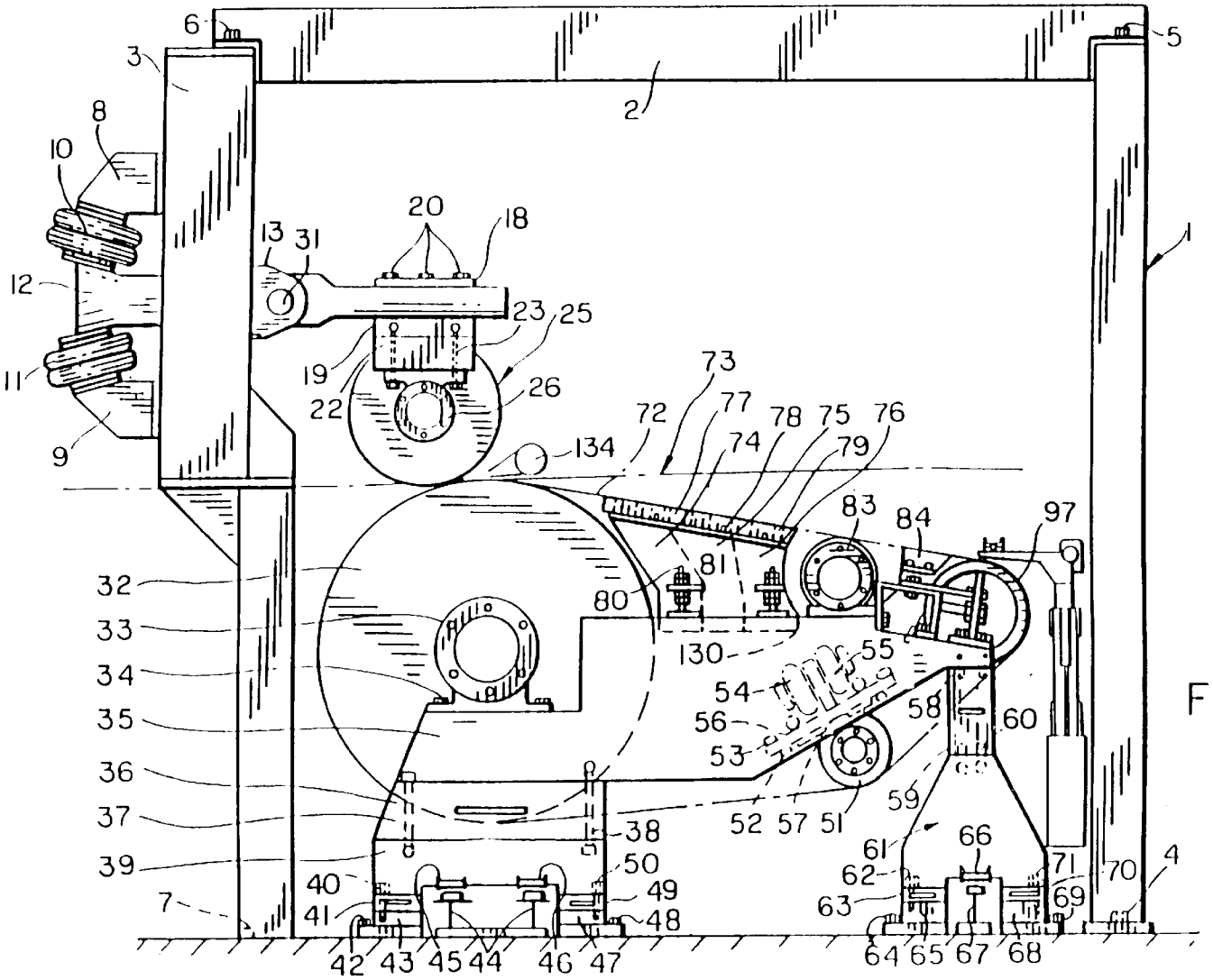
FIG. 1 is an elevation view of the paper former showing all its constituents.
Figure 2:
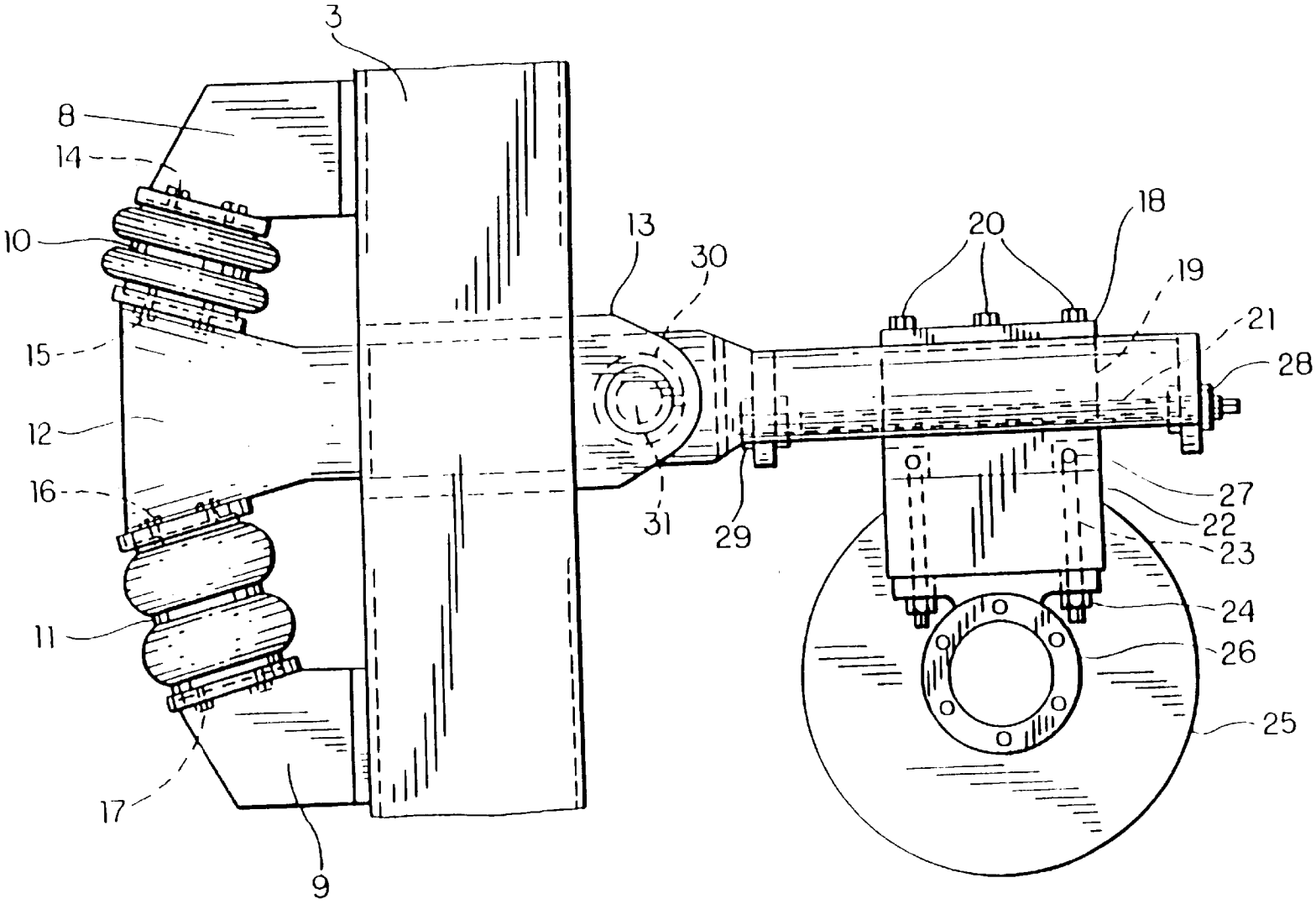
FIG. 2 is a detail of the couch roll with all the mechanisms thereof.

As shown in FIG. 1 the equipment of the present invention comprises a vertical frame (1) anchored in its lower part by screws (4) and also comprises a second frame (3) anchored in the lower part to the floor by screws (7). A beam (2) is located in the top part of both frames, joining both frames by means of screws (5) and (6). In the second frame (3), at the exit side of the paper sheet, there is located a mechanism for applying pressure or for raising the couch roll (25), this mechanism comprises two supports (8) and (9), each of them has a corresponding rubber pneumatic bellows (10) and (11) joined thereto. As can be seen in FIG. 2, the upper pneumatic bellows (10) is joined to the top part of the support (8) by screws (14) and to the lower part to an arm (12) that is attached to the couch roll by means of screws (15). The upper bellows (10) has as a function to raise the couch roll. The pneumatic lower bellows (11) is attached in the lower part to the support (9) by means of screws (17) and in the top part is attached to the arm (12) by means of screws (16). A support (13) is joined to the frame (3), said support (13) carries a bearing (30) in its central portion; said bearing houses a pin (31), that acts a fulcrum for the arm (12) which fastens the couch roll by means of a support (18) that in turn is attached to a supporting block (19) through screws (20). The supporting block (19) has a threaded hole in the central part thereof. This block adjusts its position by means of a spindle (21) fixed to the arm (12) by means of dividers (28) and (29); the supporting block (19) is attached to the journal bearing (26) that supports the couch roll by means of rotating screws (23) and a separating block (22).

The rotating screws (23) press the journal bearing of the couch screw by means of a nut (24) and rotate by means of a pin (27) fixed to the block (19).

As illustrated in FIG. 1, the equipment of the present invention also comprises a suction slider (134) that extracts the water from the sheet of paper and the felt when being pressed between the couch roll (25) and the cylinder mold (32).

Figure 3:
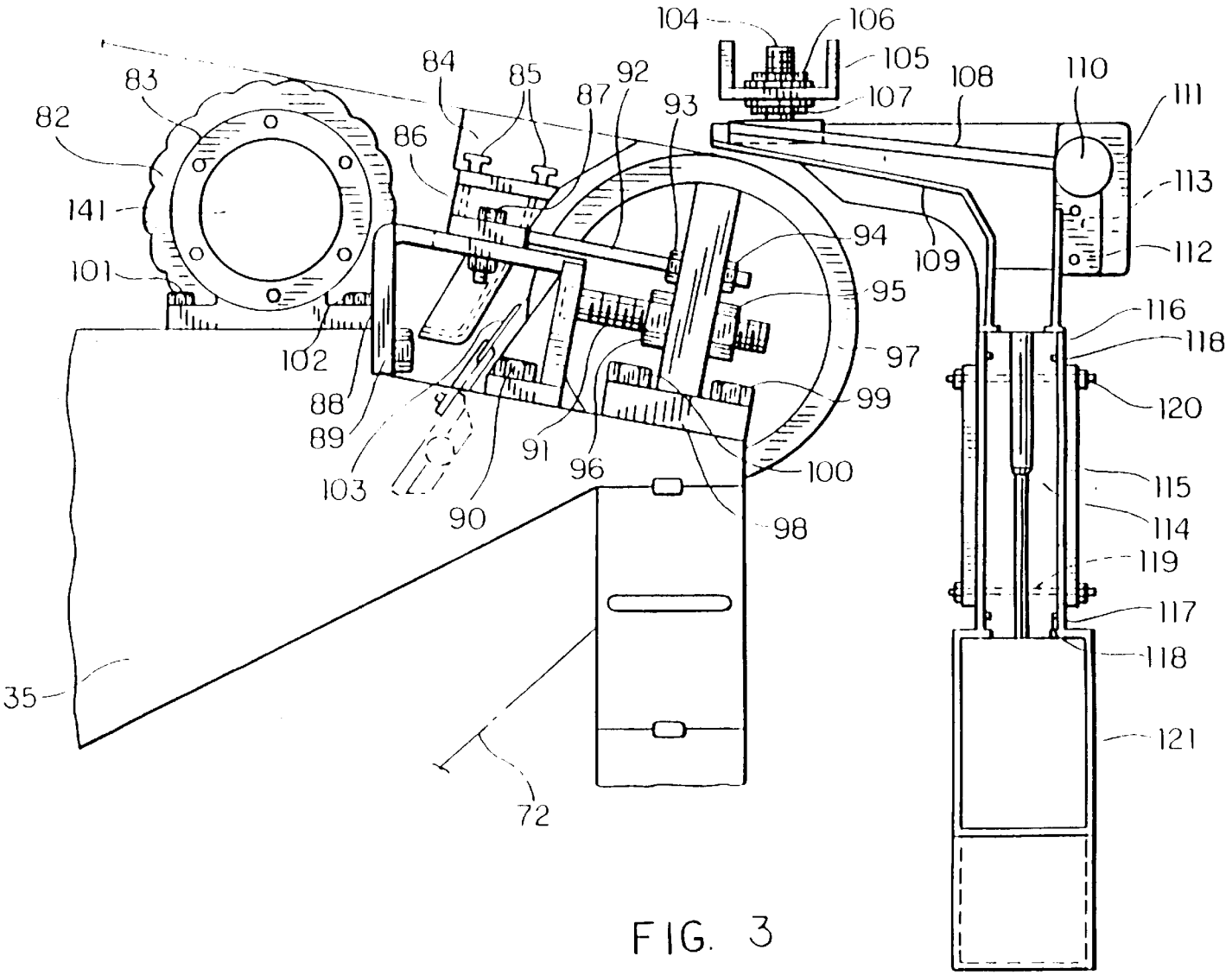
FIG. 3 shows a detail of the breast roll, the forming knife and the head box also with all their components.

In FIG. 3, it is this equipment also comprises a breast roll (97), a former roll (83) a flat box with three compartments (74), (75) and (76) having corresponding high density polyethylene covers (77), (78) and (79) in their upper part. It also has a cylinder mold (32) and a fabric lead roll (51), as well as a formation plastic fabric (72).

The flat box with three compartments (74), (75) and (76) is attached to the main structure (35) by means of screws (80) and (81) that in turn allows alignment and leveling of the box. The flat box has a plate (130) which avoids that the water drained from the former fabric (72) adhere to the inner part of the flat box compartments. The cylinder mold (32) rotates on a bearing housed in a journal bearing (33). This journal bearing is attached to a main structure (35) by means of screws (34). The main structure (35) is supported by means of two blocks (37) and (60) which in turn are attached to the bases (39) and (61) of the former equipment. These bases are attached to the supports (43), (47), (65) and (68) by means of spacer blocks (41), (49), (63) and (70). A removable block (37) is attached to the base (39) and to the main structure (35) by means of two rotating screws (36) and (38). A second removable block (60) is attached to the structure and support (61) by means of rotating screws (58) and (59). The removable blocks (37) and (60) serve to keep the whole formation unit in such a way that when it is required to change the formation fabric (72), said blocks are merely removed while the while unit remains in cantilever allowing to carry out set up of the new fabric in a minimum time. The support (39) which is located immediately below the support roll is attached to the bases (43) and (47) by means of spacers (41) and (49) held by screws (40) and (50), the support (61) which is immediately below the breast roll is attached to the bases (65) and (68) by means of spacers (63) and (70), these supports are held by means of screws (62) and (71).

The equipment of the present invention has a roll system (45), (46) and (66) which allows the unit to seat on rails (44) and (67) when the spacer blocks (63), (70), (49) and (41) are removed from the supporting position, this allows the unit to be completely removed from the machine without stopping production by merely pulling the former away from its operating position.

This unit has a system for controlling the position of the formation plastic fabric (72) by means of a guide roll (51). The mechanism for operating this guide roll operates as follows: the guide roll (51) is supported by a journal bearing (57), this journal bearing is attached to a support plate (56), which is actuated by two pneumatic adjusting bellows (54) and (55), the support plate (56) is kept in position by the rolls (52) and (53), such rolls maintain the horizontal and vertical position of the support plate. The adjusting bellows (54) and (55) adjust the position of the guide roll (51) by changing the pneumatic pressure in each one of said bellows.

This equipment comprises a former roll (83), attached to the main structure (35) by means of screws (101), which fix the journal bearing (141) about which the former roll rotates, to said structure.

Figure 6:
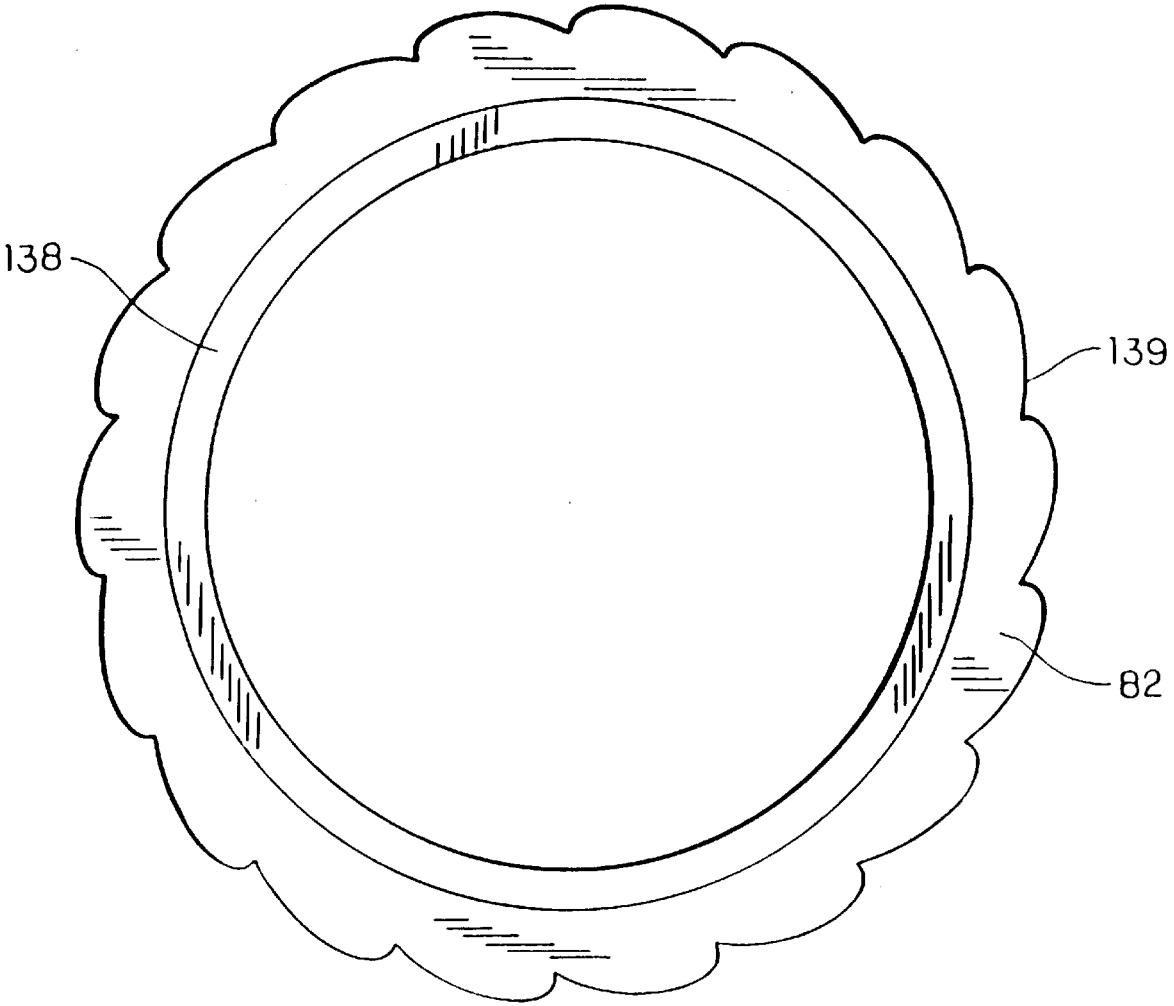
FIG. 6 illustrates a side view of the forming roll.
Figure 7:
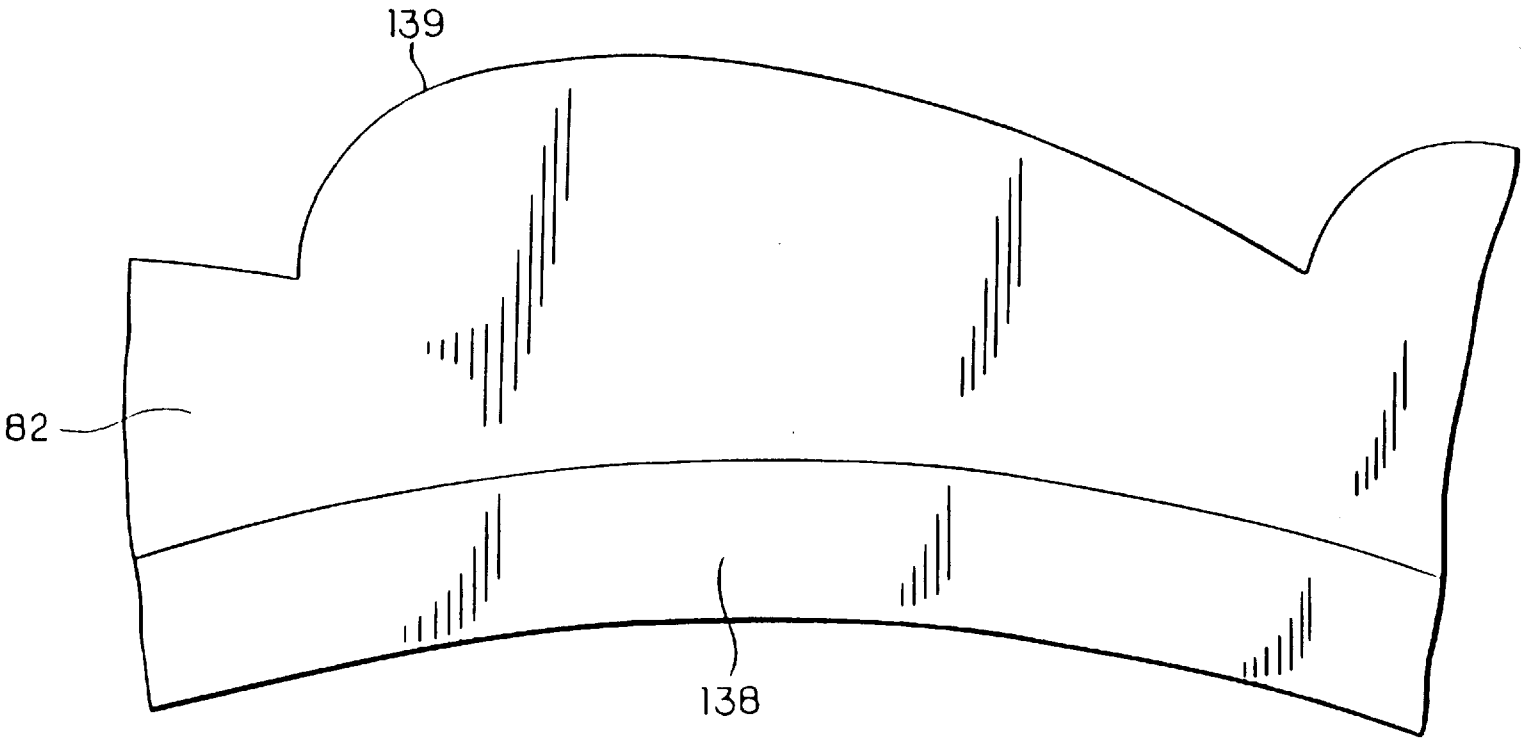
FIG. 7 illustrates a detail of the forming roll vane.

As shown in FIGS. 6 and 7, the former roll is built with a steel core (138) which is coated with a resin (82) whose surface is machined to provide thereto a streamline profile (139), which allows the generation of a positive pulse in the first contact with the fabric and a negative pulse at the time when this profile loses contact with the formation plastic fabric. The peripheral speed of the roll is lower to that of the formation fabric allowing injection of water from the lower part of the fabric to the upper part where the fiber suspension is, creating thus a rearrangement of the fibers.

The breast roll (97), shown in FIG. 3, rotates over bearings located in a journal bearing (98), which is attached to the main structure (35) by means of screws (99) and (100). Adjustment of the position of the breast roll is carried out with a spindle (91) by means of nuts (95) and (96). The spindle (91) is attached to a structure (88) which also supports the base of the formation knives (86), this base is attached to the structure (88) by means of a screw (87). The position of the base of the formation knives against breast rolls is adjusted by means of a spindle (92) and retaining nuts (93) and (94).

The structure (88) is attached to the main structure (35) by means of screws (89) and (90), the structure of the formation knives holds the formation knife (84) by means of T-shaped sliders (85).

A plastic knife (103) is provided to keep clean the breast roll (97), the plastic knife (103) plays a cleaning role and at the same time deviates the water drained by the breast roll towards a collecting tray (128).

Figure 4A:
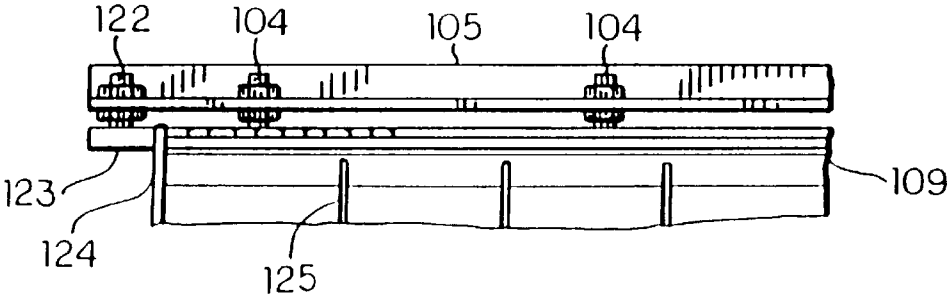
FIGS. 4*a*, 4*b* and 4*c*, illustrate the activity lip as well as all the components thereof.
Figure 4B:
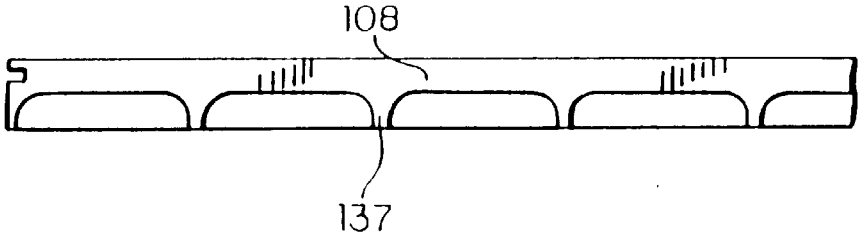
Figure 4C:
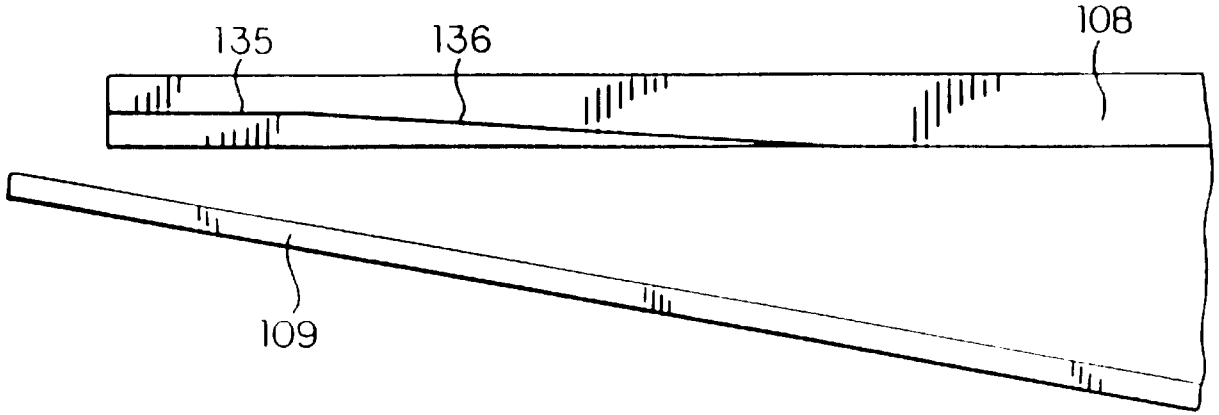

As shown in FIG. 3, the formation equipment comprises a flow head box, which comprises a conical manifold (121) whose function is to distribute uniformly the flow of the fiber suspension in a direction widthwise to the formation unit. Attached to this conical manifold by means of a throat (117), is a stepped diffuser (114) that is sealed in the lower and upper part by means of a plastic tube (118). To avoid flexing of the stepping diffuser, there is provided a plate (115) that covers completely the diffuser. The plate (115) is attached to the manifold and to the upper part of the head box by screws (119) and (120). The main role of the stepped diffuser is to maintain the fibers in a state of complete dispersion. As illustrated in FIGS. 4*a*, 4*b* and 4*c*, the head box has a lower lip (109) and an upper activity lip (108). The upper lip sets its opening position to control the discharge flow by means of screws (122) located at the ends of the head box, the box profile is adjusted by screws (104) located in the internal part of the head box, in both cases the screws are adjusted by means of retaining nuts and (104). Internal (104) and external (122) screws are attached to a bridge (105) allowing uniform movement of the lip. As illustrated in FIG. 3, at the opposite end, the upper activity lip (108) has a universal joint (110) supported over a plate (112) and to a retaining unit (111). This allows the upper activity lip (108) to move freely without fiber suspension leaks. The discharge end of the upper activity lip has a profile designed to create activity in the fiber suspension and which is able to orient high concentration of fibers; it also allows obtaining a paper of lower density. This profile is comprised by a inclined part (136) and a straight part (135), that make a change in the speed in the flow of the fiber suspension, both horizontally and vertically. The activity profile is spaced widthwise of the head box by means of sectors (137), illustrated in FIG. 4*b*, keeping the same thickness of the upper activity lip, the upper activity lip internally generated hydraulic pattern produces crossed flows over the forming table at the time the fiber suspension leaves the head box. This makes the fiber orientation to be improved transversely, that is the fiber orientation ratio in the machine direction to the transversal fiber orientation decreases. In this way, the values of the physical properties of the paper in the transversal sense tend to be similar to those in the machine sense.

Figure 5:
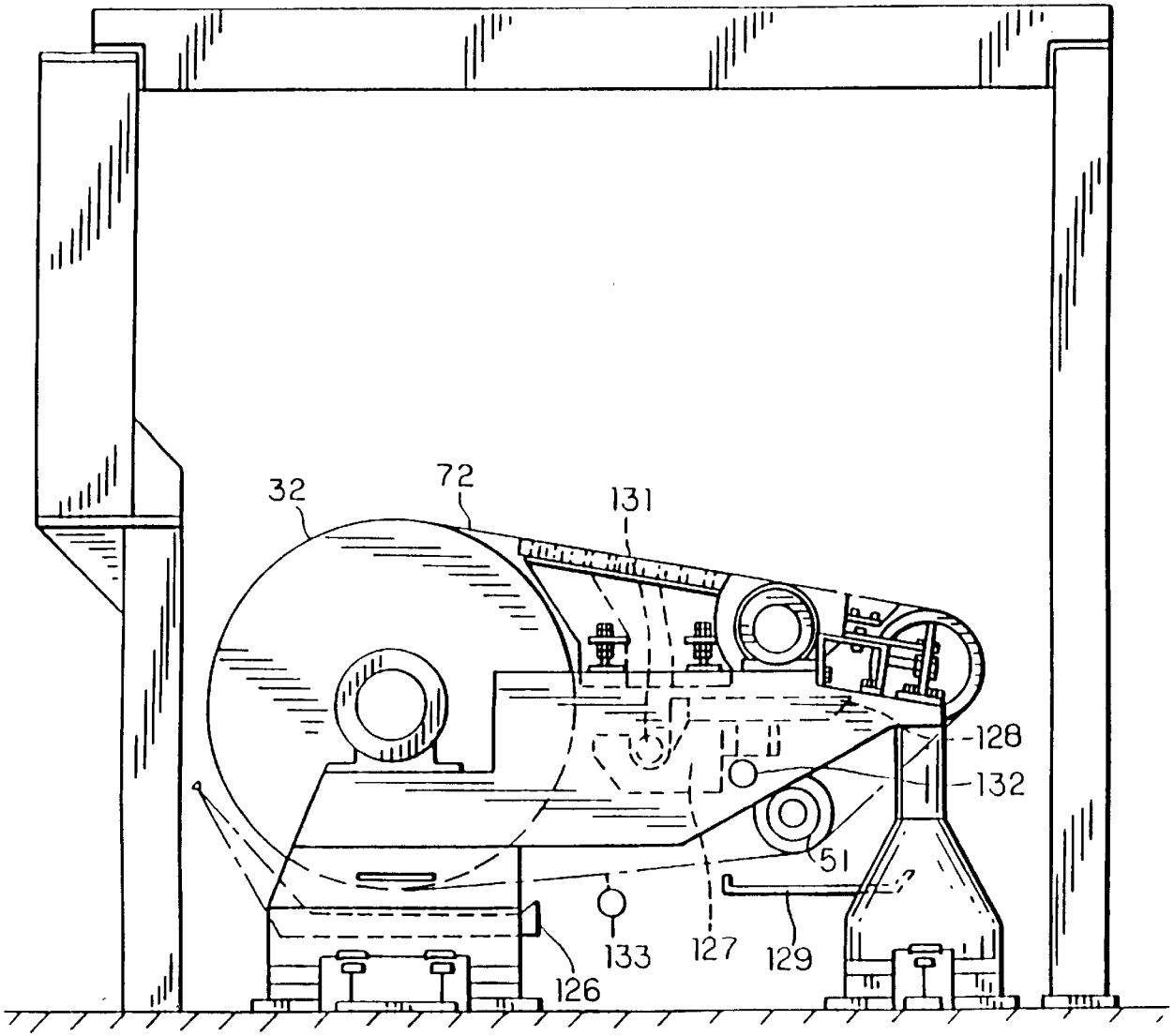
FIG. 5 illustrates the water collecting trays and showers forming part of the formation unit.

As shown in FIG. 5, shower (131) keeps the cylinder mold (32) clean. There is also a second shower (132) to keep the guide roll (51) clean. The formation fabric (72) is kept clean by means of a high pressure shower (133).

To collect the drained water in the unit there are a series of trays (127), (128), (129) and (126) collecting such water and driving it to an independent tank.

What is claimed is:

1. An under felt inclined flat former to produce a multilayer or monolayer sheet of paper, said flat former including at least a first former unit comprising:

a) support means including at least one vertical frame for supporting the unit;

b) a forming table;

c) a formation fabric;

d) flow head box means for uniformly distributing suspension of fibers over a width of the forming table, said head box means comprising i) a conical manifold;

ii) diffuser means for substantially completely dispersing fibers in the suspension flowing through the head box means;

iii) activity lip means comprising upper and lower activity lips for controlling discharge of the suspension from the head box means, said upper activity lip comprising flow control means for changing a speed and orientation of fiber flowing in the suspension through the head box means, said flow control means comprising an inclined portion and a straight portion, said inclined and straight portions providing the upper activity lip with a profile that causes the speed and orientation of the fibers flowing through the headbox means to change in both a vertical and a horizontal direction;

e) a former roll;

f) a flat box supported by the forming table;

g) a support roll;

h) a couch roll;

i) pressure-release means supported on the at least one vertical frame for releasably pressing the couch roll against the support roll whereby material for a paper sheet conveyed between the support roll and couch roll can be selectively pressed;

j) a breast roll; said forming fabric, former roll and flat box being positioned between said support roll and said breast roll;

k) roll means which allows the support roll and formation table to form a separable unit which can be completely removed from the flat former by pulling it away from its operating position;

wherein stock is introduced onto the forming fabric by the headbox which, due to a rotation of the breast roll and support roll, causes the forming fabric to pass over the forming table, former roll and flat box causing activity and dispersion of stock and to pass over the flat box which causes liquid drainage from the stock forming a sheet which is then transferred to a papermaking felt at a junction formed between the couch roll and support roll.

2. An underfelt inclined flat former as claimed in claim 1 wherein the support roll is a cylinder mold and the upper activity lip has sector means for maintaining a uniform thickness of the upper activity lip.

3. An under felt inclined flat former as claimed in claim 2 wherein the activity lip means comprises an opening through which suspension is discharged and adjustment means for controlling a size of the opening.

4. An under felt inclined flat former as claimed in claim 3 wherein the upper activity lip comprises screw means for enabling uniform movement thereof and joint means for enabling the upper activity lip to move freely without leakage of the suspension.

5. An under felt inclined flat former as claimed in claim 4 wherein the pressure-release means comprises a horizontal arm connected to the at least one vertical frame and fulcrum means for enabling the horizontal arm to pivot relative to the at least one vertical frame.

6. An under felt inclined flat former as claimed in claim 5 wherein the pressure-release means comprises an upper support and a lower support, the unit comprising upper bellows means connected to the upper support and the horizontal arm for raising and lowering the horizontal arm and a lower bellows connected to the lower support and to the horizontal arm.

7. An under felt inclined flat former as claimed in claim 2 wherein the former roll, flat box, support roll and former table form a separable unit and flat former comprises block means for detachably mounting said separable unit on the base.

8. An under felt inclined flat former as claimed in claim 7 wherein the block means comprises a plurality of blocks, the flat former comprises a bearing means for enabling rotating of the cylinder mold, said bearing means being connected to a main structure which is supported on said plurality of blocks.

9. A flat former as claimed in claim 7 which includes at least two flat formers being positioned in series, a first flat former and second former and roll means for enabling removal of the first former from operation without interrupting operation of the second former.

10. An under felt inclined flat former as claimed in claim 9 wherein the first former unit comprises rails and the block means comprises spacer blocks which, when removed, allow the first former unit to seat on the rails.

11. An under felt inclined flat former as claimed in claim 1 wherein the pressure-release means comprises a journal bearing that supports the couch roll, block means connected to the journal bearing and a horizontal arm for supporting the couch roll and spindle adjustment means for adjusting a position of the block means.

12. An under felt inclined flat former as claimed in claim 1 wherein the former roll comprises surface means for generating alternating positive and negative pulses to the formation fabric when the formation fabric is conveyed over the former roll.

13. An under felt inclined flat former as claimed in claim 12 wherein the surface means comprises a resin having a surface with alternate crests and ridges.

14. An under felt inclined flat former as claimed in claim 1 wherein the support means comprises at least a second vertical support and a horizontal beam connecting said first and second vertical supports.

15. An apparatus comprising a plurality of under felt inclined flat formers, each of said under felt inclined flat formers in said plurality being constructed in accordance with claim 1 and being positioned in series.

16. An under felt inclined former in a papermaking machine, said former comprising:

a breast roll;

a support roll downstream of the breast roll;

drainage means positioned between the breast roll and support roll; said breast roll, support roll and drainage means being positioned under a papermaking felt on a papermaking machine;

a forming fabric engaging said breast roll and support roll in an endless loop and passing over said drainage means which removes liquid from stock on the forming fabric;

a couch roll positioned above a papermakers felt and above said support roll to cause said papermaking felt to engage the forming fabric so as to allow a transfer of a sheet formed on the forming fabric to said papermaking felt;

said drainage means and forming fabric being inclined with respect to said papermaking felt;

a headbox positioned above the forming fabric for placing stock thereon;

activity inducing means located between the breast roll and support roll and under the forming fabric for inducing activity and dispersion of stock on the forming fabric; and wherein stock is introduced onto the forming fabric by the headbox which, due to a rotation of the breast roll and support roll, causes the forming fabric to pass over the activity inducing means which causes activity and dispersion of stock and to pass over the drainage means which causes liquid drainage from the stock forming a sheet which is then transferred to a papermaking felt at a junction formed between the couch roll and support roll.

17. An under felt inclined flat former in accordance with claim 16, wherein said activity inducing means comprises a former roll and said drainage means comprises a flat box.

18. The under felt inclined flat former in accordance with claim 16 wherein said support roll is a cylinder mold.

19. The under felt inclined flat former in accordance with claim 16 wherein said headbox comprises a stepped diffuser which maintains the stock in a state of dispersion.

20. The under felt inclined flat former in accordance with claim 19 further comprising upper activity lip at the headbox for creating activity in the stock.

21. The under felt inclined flat former in accordance with claim 16 wherein said former includes support means for supporting said former under a papermaking felt and includes means for pulling the former away from under a papermaking felt without stopping production thereon.

* * * * *

UNITED STATES PATENT AND TRADEMARK OFFICE

CERTIFICATE OF CORRECTION

PATENT NO. : 5,820,735

DATED : October 13, 1998

INVENTOR(S) : Cabrera y Lopez Caram

It is certified that error appears in the above-identified patent and that said Letters Patent is hereby corrected as shown below:

On cover page, second line, kindly change "Cabrera Y Lopez Caram" to --Cabrera y Lopez Caram--; and

On cover page, after Inventor:, kindly change "Luis Fernando Cabrera Y Lopez Caram" to --Luis Fernando Cabrera y Lopez Caram--.

Signed and Sealed this

Ninth Day of March, 1999

*Attest:*

Q. TODD DICKINSON

*Attesting Officer*

*Acting Commissioner of Patents and Trademarks*